United States Patent [19]

Bird

[11] Patent Number: 4,709,539

[45] Date of Patent: Dec. 1, 1987

[54] GIRTH STRAP

[75] Inventor: Elizabeth A. Bird, West Midlands, England

[73] Assignee: Cottage Industries (Equestrian) Limited, Worcestershire

[21] Appl. No.: 773,434

[22] Filed: Sep. 6, 1985

[30] Foreign Application Priority Data

Sep. 7, 1984 [GB] United Kingdom ..... 8422688
Jun. 10, 1985 [GB] United Kingdom ..... 8514650

[51] Int. Cl.[4] ..... B68C 1/14
[52] U.S. Cl. ..... 54/23; 54/46
[58] Field of Search ..... 54/23, 35, 46, 58; 24/265 BC, 265 EC

[56] References Cited

U.S. PATENT DOCUMENTS

| | | | |
|---|---|---|---|
| 275,203 | 4/1883 | Hanford, Jr. | 54/58 |
| 308,130 | 11/1884 | Button | 24/265 BC |
| 1,678,373 | 7/1928 | Wiesenfeld | 54/23 |
| 3,807,135 | 4/1974 | Leiderman | 54/23 |
| 4,187,663 | 2/1980 | LaCroix, Jr. | 54/23 |

FOREIGN PATENT DOCUMENTS 1502138 2/1978 United Kingdom .

*Primary Examiner*—Robert P. Swiatek
*Attorney, Agent, or Firm*—Becker & Becker, Inc.

[57] ABSTRACT

A girth strap which has a main body part having a tubular webbing sheath closed at opposite ends. The strap has a central nylon reinforcing band and a pair of short end straps carrying buckles. Readily releasable, elasticated end straps are attached to the main body part by tongueless retaining buckles.

18 Claims, 4 Drawing Figures

GIRTH STRAP

FIELD OF INVENTION

This invention relates to a strap, and particularly to a strap which is used with animals and in consequence will need washing periodically to maintain it in a proper condition; the strap is particularly a girth strap which, in use, is passed around the belly of an animal such as a horse, said girth strap being for example, for securing a saddle or load in position on the animal and being provided with attachment means at each end thereof for attaching the strap to appropriate means on the saddle or load.

BACKGROUND OF THE INVENTION

Such straps are often constructed from parts having different material properties to allow for the varying tensile loads imposed on the strap by the animal whilst providing a reliable, comfortable support for fastening the saddle or load to the animal.

The various parts of the strap may exhibit different relative durability characteristics and, in any event, it may be that a particular part only of the strap becomes damaged and is required to be replaced or repaired.

Girth straps require regular washing and, depending upon the different materials used in the strap, some of these materials may have a tendency to deteriorate more rapidly than the others, owing primarily to the washing process, until eventually they require replacement or repair.

Repairs and replacement of parts of the girth straps may be unnecessarily costly as well as being inconvenient, coupled with the risk that even when the repair or replacement has been carried out the overall strength of the strap may nevertheless have been reduced. Such repairs may involve breaking stitching, re-stitching and bonding and/or heat sealing which may also take a not inconsiderable amount of time and skill to effect.

Girth straps have been made traditionally from leather although leather is a relatively costly material which must be carefully selected and prepared to provide the requisite quality and also needs careful and proper maintenance in use. In consequence, other materials have also been used and, in particular, the use of carefully selected materials based on various synthetic plastics has found some favour. Also, it is known to incorporate padding or cushioning materials in the construction of such straps in order to improve comfort and reduce the risk of chafing and injury to the body of the horse.

In producing such straps, however, it is also frequently necessary to ensure that their overall resilient stretching characteristics or elasticity under tensile load falls within closely defined limits. This can be a general requirement, but control of this overall elasticity combined with a high breaking strength can be especially important when the strap is likely to be subjected to high and variable tensile loading.

Additionally there are various practical problems which have generally given certain disadvantages in performance when adopting alternative substitute materials.

For example, various types of straps which have been produced include cotton or wool webbing girths, all elastic girths composed of elastomeric material, lampwick girths, and girths composed of nylon cords. Each of these different types, however, have usually been found to have some practical characteristics which make them less satisfactory than is to be desired, arising from one or more of the following reasons:

(a) a tendency to rot giving a limited life;

(b) a tendency for an excessive sweat absorption and insufficient "breathing" of the material leading possibly to hardening or other deterioration in physical characteristics of the material;

(c) a low resistance to washing which has a deleterious effect on the article or material thereof;

(d) insufficient or excessive resilience or elasticity;

(e) a tendency to chafe or to exert excessive pressure unevenly, in undesirable localized areas, against the body of the horse.

For a considerable period of time various designs of girth straps have been developed from various materials in an effort to prolong the effective useful life of the strap whilst maintaining required overall resilient stretching characteristics or elasticity under tensile load.

One important and popular form of girth strap has a main body part with a pair of end straps at one end thereof permanently attached thereto, for example by stitching. In this particular design, most especially with leather girths, such end straps have been composed of elasticated material. With elasticated end straps, however, the main body of the strap, especially if it were to be composed of synthetic material, is likely to have greater overall durability than these end straps and is less likely to rot or otherwise deteriorate in physical properties. Therefore, there is a tendency for the elasticated end straps to deteriorate to an unacceptable level long before the useful life of the remainder of the girth strap has expired. In order to achieve a practical design, hithertofore such end straps have necessarily been permanently secured to the remainder of this girth strap, but this has created practical difficulties for possible repair and replacement of these end straps when they have deteriorated. This is particularly true if a girth of synthetic material is contemplated, and such repair and replacement is generally uneconomic.

It is an object of the present invention to at least reduce the aforementioned problem caused by differing durability and levels of deterioration of various parts of a girth strap and/or the aforementioned problem of effecting repair or replacement of various girth strap parts, in at least some designs of girth strap.

SUMMARY OF INVENTION

According to one aspect of the present invention there is provided a girth strap comprising a pair of straps releasably attached to one end, said pair of straps having attachment means, for example tongued buckles, to attach the girth strap to a saddle or other support.

Preferably, the end straps are attached on the outside of a main body part of the girth strap rather than, for example, being attached in between layers of the girth strap or in a hole in the girth strap, either of which could possibly be disadvantageous and may tend to impair the strength of the girth. Conveniently, the end straps are more resilient than the main body part and are, preferably, elasticated.

Preferably, each of the pair of end straps is attached to the main body part by an interengaging retaining buckle, preferably, of two-part construction and/or preferably the buckle is tongueless.

The buckle may be located on the outside of the main body part with a first one of said buckle parts being connected to the outside of said main body part and the other one of said buckle parts being connected to the associated end strap, said two buckle parts being interengageable with one another.

The end straps may be looped through both buckle parts to provide a very strong and secure fastening.

According to a second aspect of the present invention there is provided a girth strap comprising at least a pair of end straps, each releasably connectable to one end of said girth strap by a two-part interengaging retaining buckle located on the outside of a main body part of the girth strap. A first one of said buckle parts is connected to the outside of said main body part and the other one of said buckle parts is connected to the associated end strap. Said buckle parts are releasably interengageable with one another, with each said end strap carrying releasable attachment means for releasably attaching the girth strap to a support.

According to a third aspect of the present invention there is provided a girth or cinch strap comprising at least one end strap releasably connectable to one end of said girth or cinch strap by a two-part interengaging retaining buckle located on the outside of a main body-part of the girth or cinch strap, a first one of said buckle parts being connected to the outside of said main body part and the other one of said buckle parts being releasably interengageable with one another, said end strap carrying releasable attachment means for releasably attaching the girth or cinch strap to a support.

The, or each, said end strap is, preferably, more resilient than the main body portion and is, preferably, elasticated.

Preferably, the, or each, said end strap is releasably connectable to said end of said girth strap by means of said end strap being passed through said first one of said buckle parts and the said two buckle parts being urged into engagement with one another. Indeed, in a preferred embodiment the, or each, said end strap is looped through both of said associated buckle parts to provide an extremely strong and reliable engagement which can only be released with a very deliberate action, thereby avoiding any accidental release.

Preferably, in order to avoid the possibility of any weakening of the, or each, end strap or buckle, the retaining buckle is tongueless so that no interengaging tongue and hole/notch releasable connection of the, or each, end strap to the end of the girth or cinch strap of any sort is provided which has the tongue passing through the said end strap or buckle.

Preferably, said two retaining buckle parts are closed shapes and may be made of a rustless or rust protected material, for example, of metal such as nickel-plated steel. Conveniently, the retaining buckle is made of the same material as the attachment means on said end strap for attaching the girth or cinch strap to a support.

In one embodiment the first part of the retaining buckle comprises a U-shaped portion upstanding from the general plane of said first part which is embraced by the second part of the retaining buckle. The U-shaped portion has an inner edge providing a bearing surface for a transverse bar portion of the second part of the buckle and additionally, the legs of the U-shaped portion are curved upwardly to form guide edges for the second part.

Said buckle parts may be attached respectively to the main body of the girth strap and to the, or each, end strap by strong nylon or polyester webbing stitched thereto.

The buckle parts may advantageously be designed to be slim and to project laterally of the main body of the girth or cinch strap only by a small amount, thus avoiding any excessive bulk or projection liable to impede or interfere with contact between the animal and a rider.

Additionally, the, or each, end strap may be provided with a keeper loop, preferably of nylon stitched on to the main body of the girth strap, so that the end strap is restrained from hanging loosely.

The keeper loop could be made dual purpose and also act as a keeper loop for the billet strap of a saddle or the like to which the releasable attachment support means on the associated end strap is attached.

The girth or cinch strap may be constructed from non-leather materials and advantageously the main body portion is made up into an elongate tubular webbing sheath closed at opposite ends thereof. Said sheath is composed at least partly of staple fibres of synthetic polymer material, and enclosed within said sheath is an insert filling composed of at least one strip of foam expanded plastics extending between said closed ends of the sheath and filling the interior thereof.

Preferably, a reinforcing band of nylon or the like runs substantially the length of the girth strap and may be secured, for example by stitching, on the outer face thereof.

Further, according to the present invention there is provided a saddle or harness assembly including a girth strap according to any of the aforegoing statements of invention.

It is an advantage of the present invention that said end straps may be removed completely from the girth strap before washing so that said end straps are not subjected to unnecessary deterioration. Also, the, or each, said end strap may be removed simply, without undue inconvenience, and a replacement or repaired end strap attached to the girth strap in a readily acceptable manner.

BRIEF DESCRIPTION OF THE DRAWINGS

An embodiment of a girth strap in accordance with the present invention will now be described, by way of example only, with reference to the accompanying drawings in which.

DESCRIPTION OF PREFERRED EMBODIMENT

Figure 1:
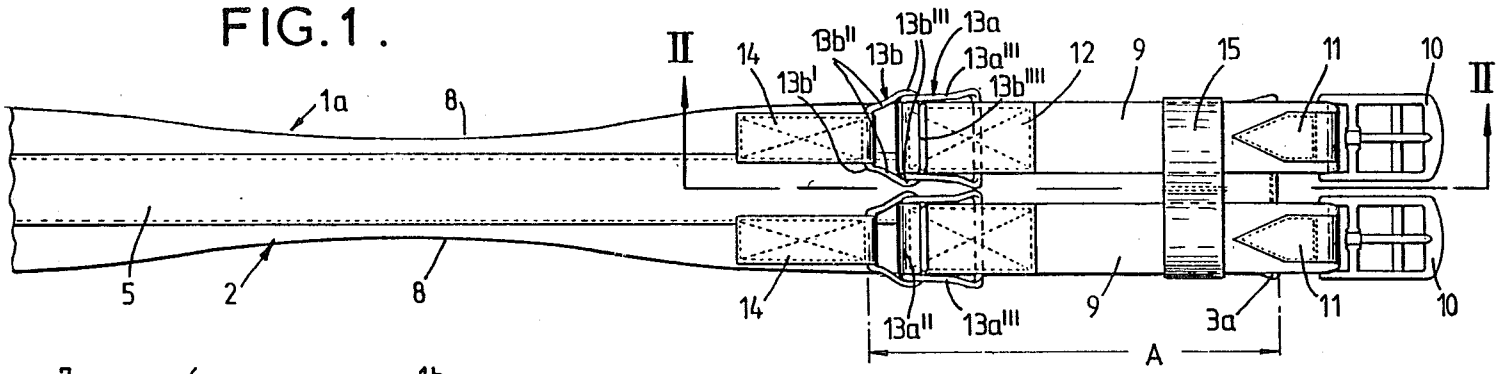
FIG. 1 and FIG. 1A show portions of a front view of the strap which has been divided into two halves.
Figure 1A:
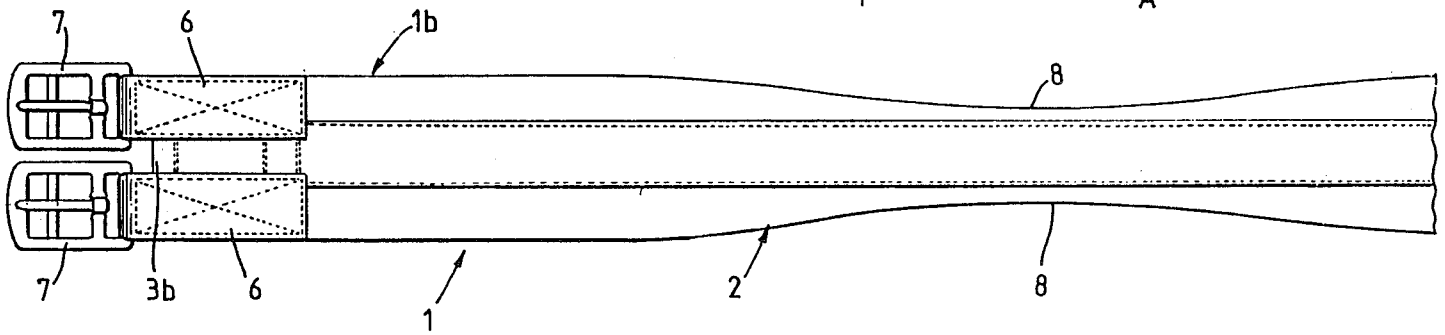

FIG. 1 shows a girth or cinch strap 1 which, for the sake of convenience, has been divided into two halves; the right hand half 1*a* of the strap 1 is shown above the left hand half 1b in FIG. 1.

Referring to the figures, the girth strap 1 has a main body part 2 which comprises an elongate tubular webbing sheath 3 of substantially flat cross-section containing a cellular or insert filling 4. As shown, sheath 3 is closed at opposite ends 3*a*, 3*b* thereof.

The sheath 3 in this embodiment is conveniently formed of a fabric consisting principally of woven yarn composed of staple polyester fibres, such as 'Terylene' fibre, which may have an outer layer on its exterior surface of cotton fabric to provide a soft surface texture.

The insert filling 4 consists of a single continuous strip which has a cross-section commensurate with the interior cross section of the sheath 3. Filling 4 extends from end to end of the sheath 3 and is composed of foam cross-linked expanded polyethylene such as the material marketed by Rubber & Plastic Industries Limited of Birmingham under the trade name EVAZOTE or PLASTAZOTE. This is a compressible sponge-like resilient material which gives shape and substance to the girth.

In making up the strap 1, the insert filling 4 may conveniently be introduced into the sheath 3 during forming the latter by folding over and stitching a length of flat fabric to enclose the insert filling and to provide the tubular structure. The open ends of the sheath 3 may be heat-sealed. The strap 1 has a central nylon reinforcing band 5 running the whole length of strap 1 and a pair of short end straps 6 carrying attachment fittings in the form of high quality rust protected tongued buckles 7.

The reinforcing band 5 and the end straps 6 are advantageously made of polyester or nylon braid or webbing. Band 5 and straps 6 are secured by permanent machine stitching with nylon thread, with the stitches passing through the insert filling 4 which is locally compressed.

In this design the strap 1 is contoured at 8 to fit the horse comfortably but the strap 1 need not necessarily be contoured.

The left hand half 16 of the strap 1 is generally of conventional form and, therefore, will not be further described.

The main body 2 of the strap 1 described above is found to be extremely well-suited to its purpose and, with the materials employed, repeated washings will not cause any deterioration in physical strength. Moreover, due to the tubular webbing sheath having a soft surface texture and being free of sharp or hard edges, it provides freedom from any tendency to chafe the horse. It is not adversely affected in use by sweat or moisture absorption. It has surface characteristics which give adequate friction grip qualities without unduly constraining the horse. Although it is soft and flexible, the girth has a very high strength and hard wearing long-life characteristics.

Particularly in the U.S.A., it is conventional to provide the necessary elasticity of a girth strap by means of a pair of elastic end straps secured by permanent stitching to one end of said strap, with tongued buckles located on the free ends of the elastic end straps.

In the present embodiment of the strap 1 in accordance with the present invention, the pair of end straps 6 are composed of elasticated material but, although this material provides the desired elasticity, with repeated washings such end straps are more susceptible to deterioration than is the main body portion 2 of the strap 1.

It is for this reason, in this embodiment that the end straps 9 are attached to the main body portion 2 in a readily releasable manner, so that they may be removed from the strap 1 prior to washing.

Figure 2:
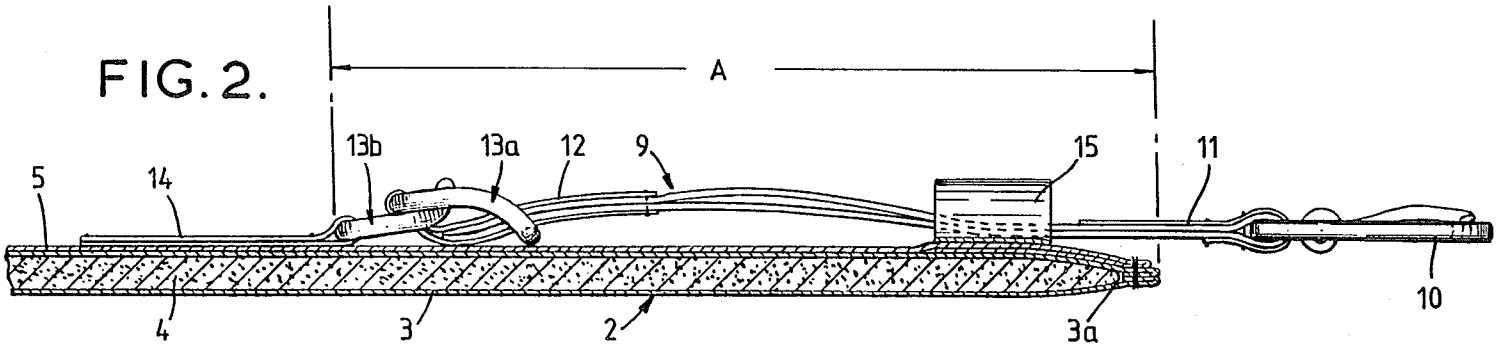
FIG. 2 shows a sectional view taken on the line II—II of FIG. 1.

Each elasticated end strap 9 is looped through a conventional rust-protected tongued buckle 10 similar to buckles 7 to provide an advantageous double elasticated layer, and a nylon reinforcing band 11 is secured to each end strap adjacent the buckle 10 by stitching (see FIG. 2). The free ends of each strap 9 are overlapped and embraced by another nylon reinforcing band 12 which is secured to the strap 9 by stitching. Each band 12 is itself passed and looped through a first specially shaped rust-protected metal retaining buckle part **13*a* which is co-operable with a second rust-protected metal retaining buckle part 13*b*; the second buckle part 13*b* is permanently attached to the main body part 2 of the strap 1 by a nylon reinforcing band 14 which is looped through buckle part 13*b* and secured to the part 2 by stitching. The two parts of the retaining buckle 13*a*, 13*b*, co-operate to retain the associated end strap 9 on the portion 2 when the strap 9 is subject to a tensile load. The tongued buckles 10** are for attachment to appropriate billet straps on a saddle (not shown).

The strap 1 also has nylon keeper loops 15 through which the associated end strap 9 is passed to prevent the strap 9 from hanging loosely.

Figure 3:
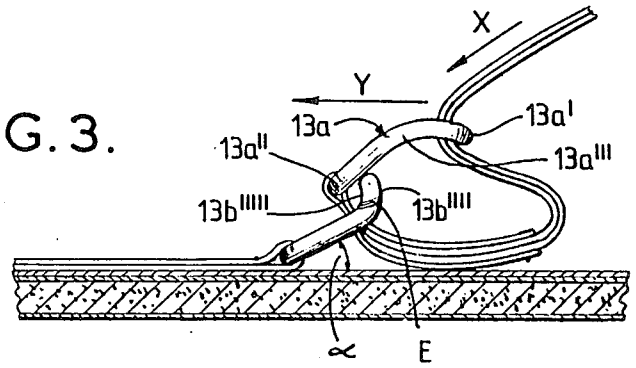
FIG. 3 shows a fragmentary view similar to FIG. 2 but showing an intermediate stage in assembling an end strap onto a main body portion of the girth strap.

FIG. 3 illustrates an intermediate stage in assembling or disassembling an end strap 9 to or from the body portion 2. In order to remove an end strap 9, the buckle 10 is pulled through keeper loop 15 and the elasticated strap 9 is pushed in the direction of arrow X through buckle part **13*a* until the tongued buckle 10 is pulled all the way through the buckle part 13*a*. Because of the relative dimensions of the strap 9, retaining buckle 13*a*, 13*b* and tongued buckle 10, a very positive action is required to pull buckle 10 all the way through part 13*a*, coupled with some degree of force. The buckle 10 is turned and the strap 9 is twisted along its length so that buckle 10 twists relative to buckle part 13*a* in order for buckle 10 to pass through part 13*a*. Once buckle 10 has been pulled through buckle part 13*a*, the whole end strap 9 can be removed by pulling on buckle part 13*a* from end 13*a*' in the direction of arrow Y, thereby pulling the tongued buckle 10 through buckle part 13*b*. Once again a very deliberate action is required as the buckle 10 will only just pass through buckle part 13*b*; and, in fact the buckle part 13*b* needs to be pivoted from the angle $\alpha$ between part 13*b* and body part 2 to an angle of about 90° for the tongued buckle 10 to pass through the part 13*b*. Buckle parts 13*a*, 13*b* extend only slightly beyond the lateral edges of the body portion 2**.

More specifically, buckle part **13*b* is a closed frame having a transverse bar portion 13*b*' and outwardly diverging limb portions 13*b*'' which merge into curved portions 13*b*'''. Portions 13*b*''' merge into a generally U-shaped portion 13*b*'''' which is raised out of the general plane occupied by the remainder of the part 13*b*; i.e., parts 13*b*', 13*b*'', 13*b*''' are generally in the same plane and 13*b*' is parallel to 13*b*''''. Inner edge 13*b*''''' of part 13*b* is a bearing edge for transverse bar portion 13*a*'' of part 13*a* covered with band 12. Part 13*a* is also a closed frame and, as shown in FIG. 1, limb portions 13*a*''' diverge gradually from the bar portion 13*a*'', and, as shown in FIGS. 2 and 3, curve gradually downwardly to bar or end portion 13*a*' which is generally parallel to bar portion 13*a*''. The outer edges E (one shown in FIG. 3) of the legs of the U-shaped portion 13*b*'''' curve inwardly and upwardly, and act as guide edges for the inner edges of limb portions 13*a*'''. Bar portion 13*a*'' is of similar to just greater extent than the U-shaped portion 13*b*''''therefore bar portion 13*a*'' and limb portions 13*a*''' embrace the U-shaped portion 13*b*''''. There is only a very limited amount of lateral play between the parts 13*a* and 13*b* when the end strap 9** is under a tensile load.

It should be said that the design of the retaining buckles employed to allow removal of the end straps is particularly advantageous, particularly where a pair of end straps, or more than one end strap, are located at one end of the girth strap since the provision of two or more end straps at one end compounds the problems in providing a strong, reliable, durable, readily releasable method of fastening. Having the buckle 13*a*, 13*b* and end straps 9 on the outside of the main body portion 2 allows the end strap 9 to be provided without weakening of the strap 1.

Any releasable fastening of the end straps 9 should not contact or rub the horse. Therefore the buckle parts 13*a*, 13*b* are connected to the outer face of the girth strap 1 in order not to contact with the belly of the horse at some distance A, in from the end of the main body portion 2.

The buckle parts 13*a*, 13*b* are not bulky; they are slim, do not project, and lie generally flat. They provide a secure non-slip arrangement when the end strap 9 is under tensile load, and there is no foreseeable risk of accidental release since a very deliberate action is required to remove the end straps 9. Additionally, the fastening is substantially self-tightening and bears directly on the main body 2.

If preferred, the buckle parts 13*a*, 13*b* could be interchanged so that part 13*b* is attached to the end strap 9 and part 13*a* is attached to the main body portion 2.

The shape and design of the buckle parts 13*a*, 13*b* is very deliberate in order to meet the strict requirements of reliability, durability and comfort already mentioned herein and these criteria could not be met by, for example, a tongued buckle connection of a generally conventional principle. Such a fastening could result in the relatively rapid wear of the elasticated end straps and would not be a practical solution to the problem. Also, a tongued buckle normally requires the provision of holes and, especially in synthetic straps, eyelet fittings which are likely to represent a point of weakness and are generally undesirable in an article such as a girth strap.

The girth strap has been described as being for fixing to a saddle but could alternatively be part of a harness assembly.

What I claim is:

1. A strap, for attachment to a saddle or other support, comprising:

a girth strap having a main body with a first end and a second end;

a pair of end straps, each of which has a first end that is releasably attached to said first end of said main body of said girth strap, and a second end; and respective attachment means provided on said second ends of said end straps, and on said second end of said girth strap, for effecting said attachment of said strap;

said main body of said girth strap being provided with an inside surface which is intended to face toward an animal, and an outside surface which is remote from said inside surface, with each of said end straps being attached to said outside surface of said main body;

each first end of said end straps being provided with an interengaging retaining buckle to effect said releasable attachment to said first end of said main body of said girth strap.

2. A strap according to claim 1, in which each retaining buckle comprises a first buckle part and a second buckle part.

3. A strap according to claim 2, in which said retaining buckle is tongueless.

4. A strap according to claim 2, in which said first buckle part is connected to said first end of said end strap, and said second buckle part is connected to said outside surface of said main body of said girth strap, with said first and said second buckle parts being interengageable with one another.

5. A strap according to claim 4, in which each of said end straps is looped through both said first and said second buckle parts.

6. A strap, for attachment to a saddle or other support, comprising:

a girth strap having a main body with a first end and a second end, with said main body being provided with an inside surface which is intended to face toward an animal, and an outside surface which is remote from said inside surface;

at least one pair of end straps, each of which has a first end that is releasably attached to said first end of said main body of said girth strap, and a second end;

interengaging retaining buckles disposed on said outside surface of said main body of said girth strap; with each interengaging retaining buckle having a first individual buckle part and a second individual buckle part, said first individual buckle part being connected to said first end of one of said end straps and the second buckle part being connected to said outside surface of said main body of said girth strap, with said first and second buckle parts of each interengaging retaining buckle being releasably interengageable with one another; and releasable attachment means provided on said second ends of said end straps, and on said second end of said main body of said girth strap, for effecting said attachment of said strap.

7. A strap according to claim 6, in which said second buckle part comprises a U-shaped portion having an inner edge providing a bearing surface for a transverse bar which is provided on said first buckle part; said U-shaped portion of said second buckle part being in a different plane than a portion thereof which is embraced by said first buckle part; and said U-shaped portion also having legs which curve upwardly to form guide edges for said first buckle part.

8. A strap according to claim 6, in which said first and said second buckle parts are attached respectively to said main body and to said at least one end strap by webbing stitched thereto, said first and said second buckle parts being slim and projecting laterally of said main body by only a small amount.

9. A strap according to claim 6, in which said girth strap is provided with a keeper loop of nylon which is stitched on to said main body of said girth strap.

10. A strap according to claim 6, in which said girth strap is constructed from non-leather materials, with said main body being made into an elongate tubular webbing sheath closed at opposite ends thereof, said sheath being composed at least partly of staple fibers of synthetic polymer material, and enclosing an insert filling which comprises at least one strip of foam expanded plastic extending between said closed ends of said sheath and filling the interior thereof.

11. A strap according to claim 6, in which said girth strap is provided with a reinforcing band which runs substantially the length of said girth strap and is secured on said outside surface thereof.

12. A strap, for attachment to a saddle or other support, comprising:

a girth strap having a main body with a first end and a second end, with said main body being provided with an inside surface which is intended to face toward an animal, and an outside surface which is remote from said inside surface;

at least one end strap, which has a first end that is releasably attached to said first end of said main body of said girth strap, and a second end;

an interengaging retaining buckle on said outside surface of said main body of said girth strap, with said retaining buckle having a first buckle part connected to said first end of said at least one end strap and a second buckle part connected to said outside surface of said main body of said girth strap, with said first and said second buckle parts being releasably interengageable with one another; and releasable attachment means provided on said second end of said at least one end strap, and on said second end of said main body of said girth strap, for effecting said attachment of said strap.

13. A strap according to claim 12, in which said at least one end strap is more resilient than said main body of said girth strap, and is elasticated.

14. A strap according to claim 12, in which said at least one end strap is releasably connectable to said first end of said main body of said girth strap, with said first end of said end strap being passed through said second buckle part, and said first and said second buckle parts being urged into engagement with one another.

15. A strap according to claim 14, in which said at least one end strap is looped through both said first and said second buckle parts.

16. A strap according to claim 12, in which said retaining buckle is tongueless, said first and said second buckle parts are closed shapes.

17. A strap according to claim 16, in which said first and said second buckle parts are made of a material which is the same as that used for said attachment means on said second ends of said end straps, with said material being selected from the group of materials which consists of rustless and rust-protected material.

18. A strap, for attachment to a saddle or other support, comprising:

a girth strap having a main body with a first end and a second end;

a pair of end straps, each of which has a first end that is releasably attached to said first end of said main body of said girth strap, and a second end; and respective attachment means provided on said second ends of said end straps, and on said second end of said girth strap, for effecting said attachment of said strap;

said main body of said girth strap being provided with an inside surface which is intended to face toward an animal, and an outside surface which is remote from said inside surface;

each first end of said end straps being provided with an interengaging retaining buckle to effect said releasable attachment to said first end of said main body of said girth strap.

* * * * *